US006792699B2

(12) United States Patent
Long et al.

(10) Patent No.: US 6,792,699 B2
(45) Date of Patent: Sep. 21, 2004

(54) LOW SHEAR CUSTOMIZED FOOTGEAR

(75) Inventors: Kelly M. Long, Woodland Hills, CA (US); Tracy E. Grim, Thousand Oaks, CA (US); Joseph M. Iglesias, Thousand Oaks, CA (US); Kevin O'Donnell, Santa Barbara, CA (US)

(73) Assignee: Royce Medical Company, Camarillo, CA (US)

( * ) Notice: Subject to any disclaimer, the term of this patent is extended or adjusted under 35 U.S.C. 154(b) by 0 days.

(21) Appl. No.: 10/237,490

(22) Filed: Sep. 9, 2002

(65) Prior Publication Data

US 2004/0045195 A1 Mar. 11, 2004

(51) Int. Cl.[7] ..... A43B 13/38

(52) U.S. Cl. ..... 36/88; 36/93; 36/95; 36/154; 36/181; 36/155

(58) Field of Search ..... 36/43, 44, 154, 36/181, 93, 88, 110, 95, 71, 155; 602/23

(56) References Cited

U.S. PATENT DOCUMENTS

| | | | | | |
|---|---|---|---|---|---|
| 3,730,169 | A | * | 5/1973 | Fiber | 600/592 |
| 3,760,056 | A | | 9/1973 | Rudy | |
| 4,237,626 | A | | 12/1980 | Brown | |
| 5,123,180 | A | * | 6/1992 | Nannig et al. | 36/43 |
| 5,329,705 | A | | 7/1994 | Grim et al. | |
| 5,359,791 | A | * | 11/1994 | Prahl et al. | 36/145 |
| 5,548,848 | A | | 8/1996 | Huybrechts | |
| 5,761,834 | A | | 6/1998 | Grim et al. | |
| 5,778,565 | A | | 7/1998 | Holt et al. | |
| 5,797,862 | A | * | 8/1998 | Lamont | 602/10 |
| 6,098,315 | A | | 8/2000 | Hoffmann, III | |
| 6,205,685 | B1 | | 3/2001 | Kellerman | |
| 6,338,768 | B1 | | 1/2002 | Chi | |

* cited by examiner

*Primary Examiner*—M. D. Patterson
(74) *Attorney, Agent, or Firm*—Fulwider Patton Lee & Utecht, LLP

(57) ABSTRACT

An orthopaedic shoe has an outsole and a special insole including an array of independently vertically movable sections or elements which are heat moldable to retain the contour of the users foot and which serve to reduce or avoid peak pressures and evenly distribute pressure during walking. The resilient sections preferably have a height which is substantially equal to or greater than the lateral extent of the sections, to permit swaying action and to reduce shear forces on the users feet.

24 Claims, 4 Drawing Sheets

FIG. 3
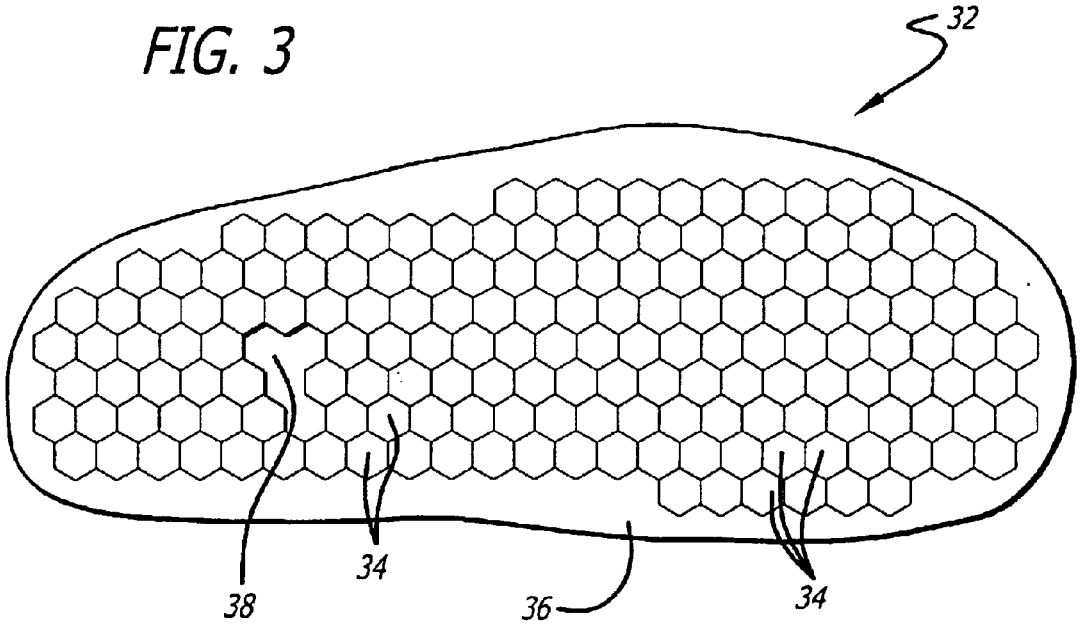
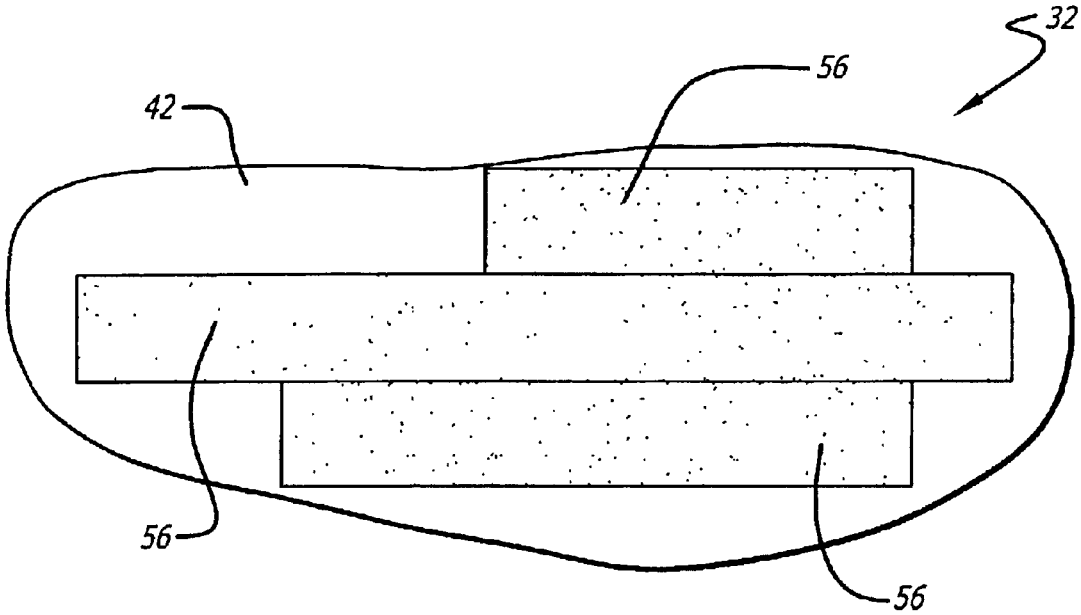
FIG. 4

FIG. 5
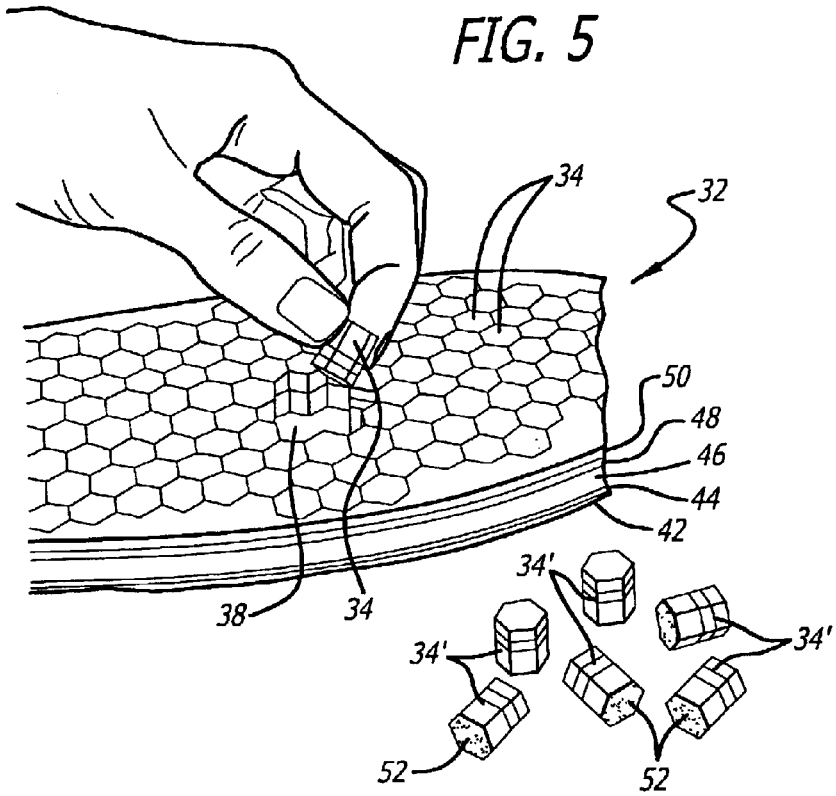
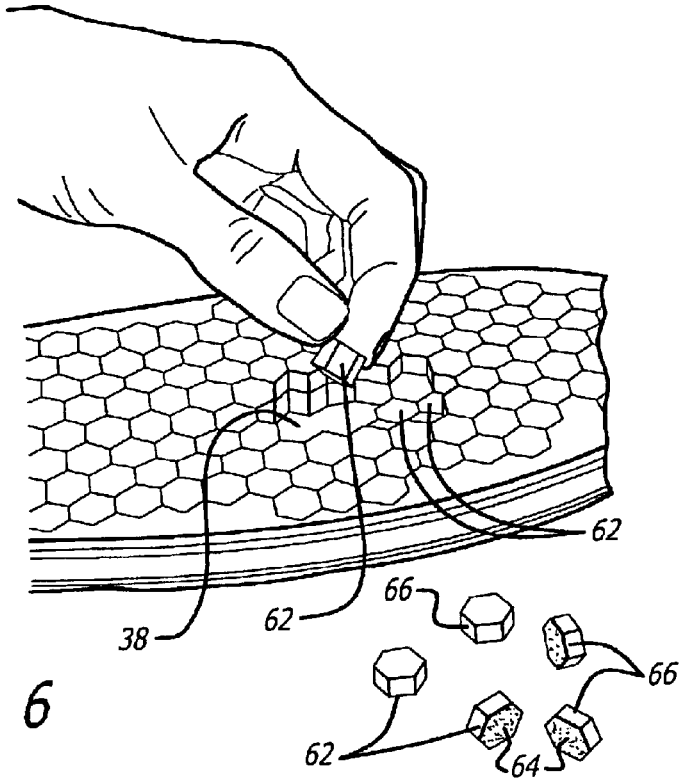
FIG. 6

LOW SHEAR CUSTOMIZED FOOTGEAR

FIELD OF THE INVENTION

This invention relates to orthopaedic footgear, particularly for patients such as diabetics, who have tender feet, or who are prone to having ulcers on the feet.

BACKGROUND OF THE INVENTION

Footgear with an array of separate sections have been manufactured heretofore by Royce Medical Company, the assignee of the present invention, and prior patents relating to this subject matter include U.S. Pat. Nos. 5,329,705, 5,761,834 and 5,778,565.

These patents disclose insoles which have many hexagonal sections which are independently movable, and which are relatively tall, such as substantially equal to their transverse dimensions or taller, providing a swaying action which reduces shear forces.

As set forth in U.S. Pat. No. 5,761,834:

"The grid pattern of resilient sections creates a multiplicity of sections that sway laterally independently of one another in response to forces applied by the foot. Typical soles simply resist lateral foot motion, thereby inducing shear stresses on the bottom of the foot which may cause or aggravate ulcers. Thus, in contrast to typical soles, the grid pattern of independently mobile resilient sections of the present invention constitutes means for reducing shear stresses on the bottom of a foot as the user walks along."

However, even with this improved swaying action, it has been determined that in some cases there are peak pressure points which may apply adverse forces to the foot.

It is further noted that the arrangements of the prior art cited above, such as the construction disclosed in U.S. Pat. No. 5,761,834, included construction for precluding "compression set" see Col. 3, lines 5–8 and Col. 8, lines 31–41 of this patent.

SUMMARY OF THE INVENTION

In accordance with an aspect of the invention it has been determined that the low shear force action of the footgear, can be improved, and undesirable high pressure points may be reduced or eliminated, by including in the independently movable sections, permanently moldable material. The molding may be accomplished by the use of heat or by other activation arrangements.

Using a heat moldable layer included in the individual sections, the footgear may be heated to a temperature of about 200° F. to 350° F., preferably 250° F. to 300° F., and the patient's foot or a mold of the patient's foot is applied to the insole to deform the heat moldable material in each section, so that the insole is custom formed to the patient.

With this arrangement, the insole distributes forces from the foot to larger areas of the insole thereby avoiding high pressure points, with the lateral swaying action of the "tall" sections still reducing shear forces applied to the foot as the patient walks or stands on the customized insole-lined footgear. The resultant construction has the tall resilient elements or sections permanently deformed with the elements at different heights, and with the upper surfaces at different angles to conform to the shape of the foot during the molding step.

This is in contrast to the use of heat moldable materials used in ski boots or the like without tall insole sections, wherein the increased contact between the footgear and the shoe may actually increase the shear forces applied to the foot. However, in the case of ski boots or the like, where athletes with good foot blood circulation are involved, the increased shear forces normally present no problem. In addition, in a preferred embodiment the use of a "sandwich" of the heat moldable material between two layers of resilient material in the tall sections can be helpful in avoiding undue "packing" of the heat moldable material so that resilience is still vigorously present in each of the "tall" sections.

In accordance with one specific illustrative embodiment of the invention, a footgear has an outsole, an inner layer of woven brush material having a loop construction, and a special insole with hook type material on the lower surface thereof to secure the insole to the outsole. The insole has a thin laminated base formed of an open cell foam with a layer of brush type hook receptive material on both sides and with upwardly extending moldable resilient elements or sections. The moldable resilient elements or sections are arranged in a grid pattern, and are less than three quarters of an inch in their cross sectional extent. In addition they are of substantial height substantially equal to or greater than ¾ of their lateral extent, with the height being preferably substantially equal to or greater than the transverse extent of the elements or sections. The upper surface of each of the elements is formed of a soft resilient material and the lower surface of the elements has hook type material thereon to engage the hook receptive fabric on the insole base in a manner similar to Velcro®. With the soft upper surface of each of the extended elements remaining in contact with the foot or sock of the patient in use, and the bottom of each element fixedly secured to the insole base, the elements sway or swing back and forth with respect to the base as the patient walks, or shifts position.

In accordance with another feature, when several of the resilient elements are removed to relieve pressure on an ulcerated area, for example, one or more inserts may be provided to place in the resultant opening. This insert or inserts may have a periphery matching that of the removed elements, but may be only a fraction of the height. This insert or inserts has the desired effect of inhibiting the movement of adjacent elements or sections into the hole left by the removal of several elements. The insert may have the shape of several of the removed elements or sections or may be formed of a series of individual inserts.

Other objects, features and advantages of the invention will become apparent from a consideration of the following detailed description and the accompanying drawings.

BRIEF DESCRIPTION OF THE DRAWINGS

FIG. 3 is a top plan view of the insole shown in FIG. 1;

FIG. 4 is a bottom view of the insole of FIG. 3

FIG. 5 is a cut-away view showing some of the removable resilient sections or elements which have been removed from the insole;

FIG. 6 is a perspective view of a single low level "filler" insert which may be placed in the space where a tall element has been removed;

DETAILED DESCRIPTION OF THE PREFERRED EMBODIMENTS

Figure 1:
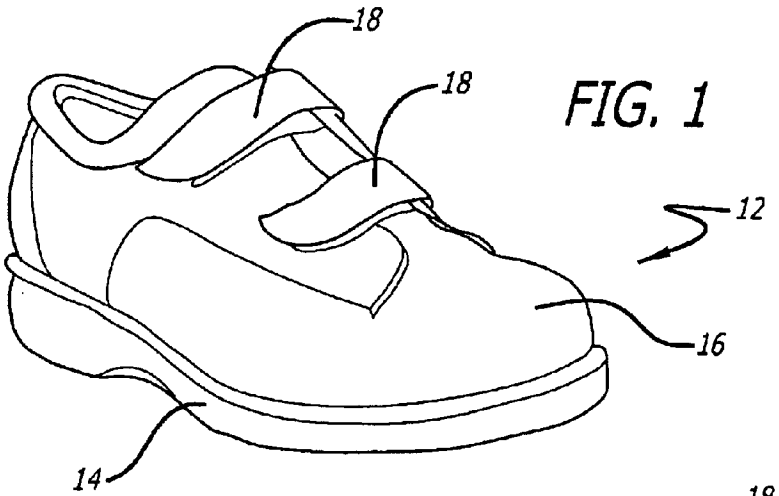
FIG. 1 is an external view of an orthopaedic shoe.

Referring now to FIG. 1 of the drawings, it shows an external leather shoe 12 having an outsole 14, and an upper 16, with straps 18 for holding the shoe closed. As indicated to advantage in FIG. 2 of the drawings, the straps are mounted on one side closure flap 20 of the shoe, extend through openings 22 on the other closure flap 24 and then are held in the closed position by mating hook and loop pads 26 on the strap 18 and 28 on the closure flap 20.

Figure 2:
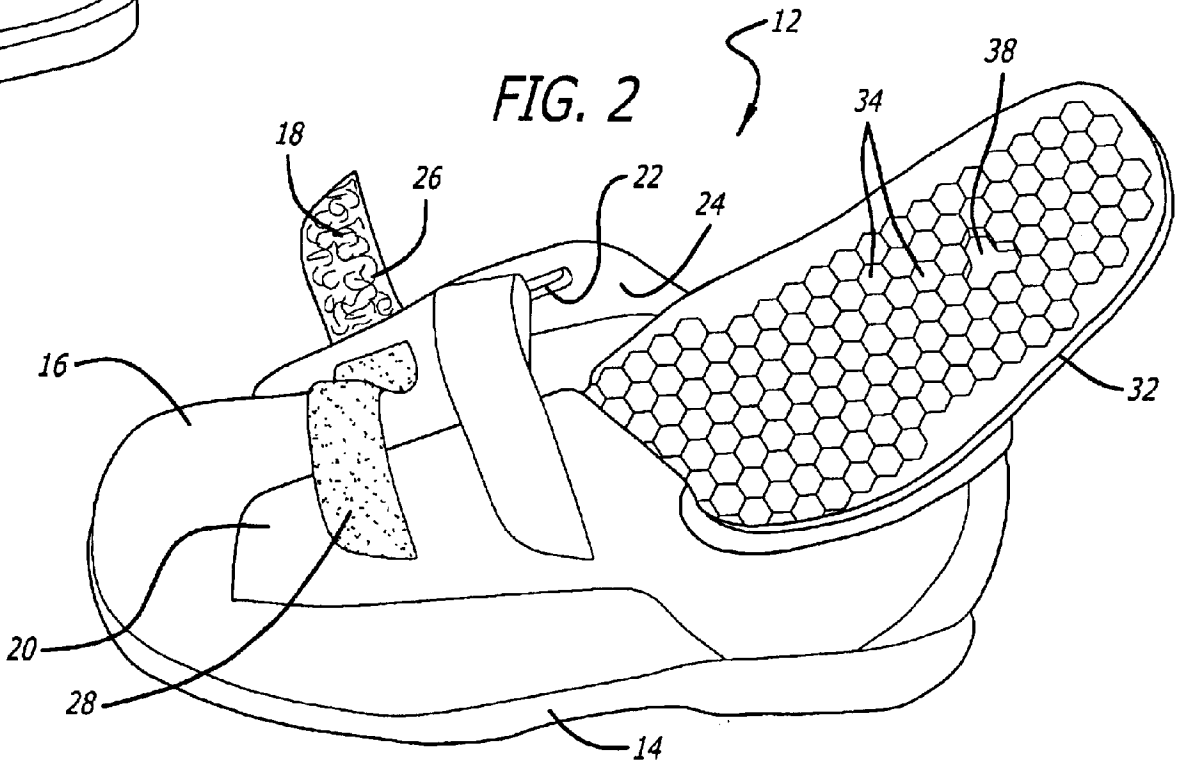
FIG. 2 is a partially disassembled view of the shoe of FIG. 1, showing an insole illustrating the principles of the invention.

Also shown in FIG. 2 is the insole 32 which includes an array of sections or elements 34.

The construction of the insole 32 will now be discussed in greater detail in connection with FIGS. 3, 4 and 5 of the drawings. Starting with FIG. 3 of the drawings, the insole 32 has a continuous peripheral rim 36 enclosing the array of tall elements or sections 34. As indicated by the openings 38 in FIGS. 3 and 5, the elements or sections 34 may be selectively removed to relieve areas on the bottom of the foot, as clearly shown in FIG. 5, in which the removed elements are designated by the reference numeral 34'.

In FIG. 5, the laminated base member 42 is shown, and the upper layer 44 of brushed woven fabric is also shown. The next layer 46 is formed of high density resilient material. A heat formable layer 48 overlies layer 46, and the topmost layer 50 of the inner sole may be formed of relatively low density resilient material. These same layers are visible in the elements or sections 34' which have been removed from the insole. In addition, the elements or sections 34' have a layer of hook type material 52 on their lower surfaces. This hook type material engages the upper layer 44 of plush fabric which has loops, with the resultant securing action being of the hook and loop type, similar to Velcro®. Accordingly, when a patient has an ulcer or other injury to an area on the sole of the foot, a few of the elements 34 may be removed to relieve the area. Subsequently, if the injury has healed, the resilient elements may be re-inserted.

In one preferred embodiment of the invention the size of the hexagonal elements or sections 34 is about ⅞ inch corner to corner and about ⅜ inch from face to opposing face. The height of the elements or sections is about ½ inch. With an insole between 11 and 12 inches in length, the array included between 180 and 200 elements or sections. More generally, it is desirable that the elements be less than ¾ inch in transverse extent; and that the height of the elements be at least half, or preferably in the order of at least ¾ of the transverse extent, or preferably substantially equal to or greater than the transverse extent of the elements. In addition, it is preferred that the insole includes in the order of 80 elements or more in the insole array.

FIG. 4 shows the bottom of the insole 32 with the laminated base 42 having several strips 56 of hook type material adhered to its surface. These strips 56 mate with the brushed woven loop type material secured to the upper surface of the outsole 14.

FIG. 6 shows a low height filler element 62 having the same peripheral shape as the elements 34. The element 62 includes a layer of hook type material 64 bonded to resilient material 66. The filler elements 62 are of relatively low height, perhaps ⅕ or ¼ the height of the tall removable elements. When the elements 34 are removed, low level filler elements 62 are preferably inserted, in order to preclude the possibility that taller elements adjacent the removed elements might lean or tilt toward the opening. Preferably, the number of the short filler elements 62 which are used is equal to the number of the taller elements 34, so that the opening is filled with the low level elements 62. Instead of individual filler elements, the filler elements may have a periphery equal to three or five of the removed taller elements or a combination, to fill the vacated space.

Figure 7:
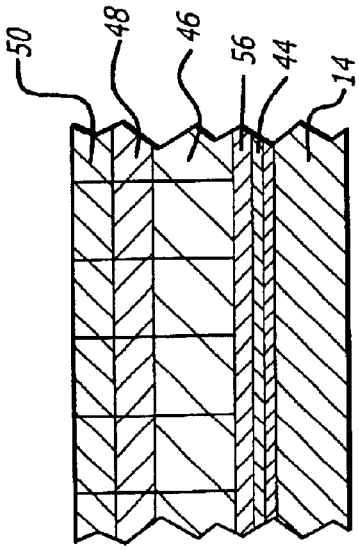
FIG. 7 is a schematic cross sectional view through the sole of the orthopaedic shoe.

FIG. 7 is a schematic cross-sectional diagram showing the layers discussed hereinabove from the outsole 14 to the upper low density resilient layer 50.

Figure 8:
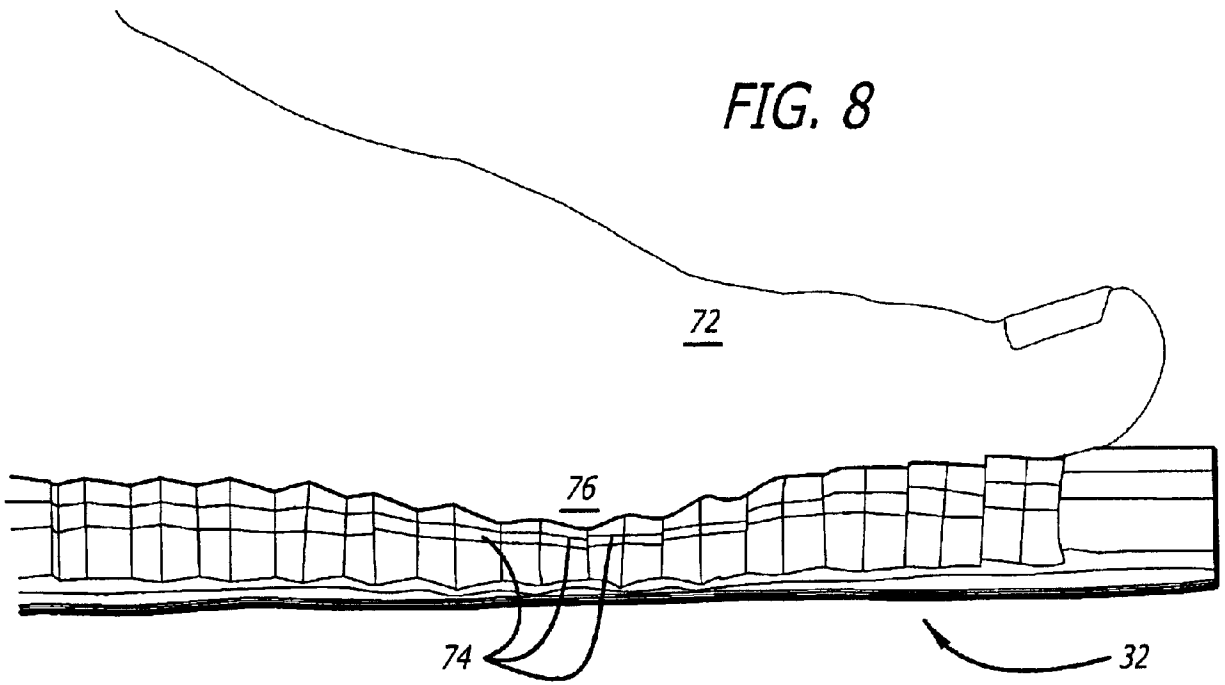
FIG. 8 is a schematic showing of the molding of a shoe to custom fit the user.

Referring now to FIG. 8 of the drawings, this is a diagrammatic showing of a part of a foot 72 engaging an insole 32 of the type described in detail hereinabove. In FIG. 8 it may be seen that the heat deformable layers 74 under the higher pressure area 76 have been reduced somewhat in the thickness, so that the insole is customized to the user. In addition, it may be noted that the individual elements may vary in height, and in the angle of the upper surface of the elements following the molding step.

For completeness we note that the heat moldable material is available as "Recoil" material from Acor Orthopaedic, Inc., 19, 530 S. Miles Parkway, Cleveland, Ohio 44128. It preferably molds at a temperature of 250° F. to 300° F. However, a broader range of operable temperatures for other heat moldable materials would be from 200° F. to 350° F. Instead of activating the molding action by heat, other activation may be employed. For example, combining two materials such as epoxy type materials, and molding during hardening could be accomplished. In addition ultra violet light hardening could be employed. In addition, instead of the specific materials and sources listed hereinabove, other materials available from other sources may be employed to achieve substantially the same result.

Regarding the non-heat moldable resilient material, the softer material is available as PORON 4701-30, and the higher density resilient material is available as PORON 4701-50, from Rogers Corporation, 245 Woodstock Rd., Woodstock, Conn. 0681-1815.

In the foregoing detailed description and in the accompanying drawings, one illustrative embodiment of the invention has been disclosed. However, it is to be understood that various modifications and alternatives may be employed without departing from the spirit and scope of the invention. Thus where the specification mentions that the sections or elements preferably have a height which is substantially equal to or greater than their lateral extent, this is intended to extend to elements having a height of three quarters of more of the lateral extent. In practice, very good results have been obtained with elements 34 which are slightly taller (about 10%) than their lateral extent. Regarding the construction of the elements, the three layered construction is preferred. However, the elements may be formed of two layers or may be entirely formed of heat moldable material but of somewhat less compressible material than that employed in the layered construction. In addition, the lateral extent of the elements or sections may vary, such as ¼ inch or 3/16 inch for specific examples. Further, in the Summary of the Invention section of this specification one very specific embodiment was described; however, various changes could be made, for example, adhesive may be employed to secure the insole to the outsole, and other similar modifications may be made. Concerning another aspect of the situation, in some cases it may be desirable to re-heat the insole to change the contour thereof. Also, the moldable material may be molded using other than heat, such as by using a mixture of two materials which harden following mixture, or by using ultra violet radiation hardenable materials, for examples. Accordingly, the present invention is not limited to the particular embodiment disclosed in the detailed description and the drawings.

What is claimed is:

1. A customizable orthopaedic footgear comprising:

an outer sole;

an inner-sole extending substantially over the entire sole area mounted in said footgear above said outer sole, said inner sole having a plurality of independently vertically movable, sections arranged in a grid pattern, said independently vertically movable sections having lower surfaces which are mounted within said footgear, and upper surfaces for engagement by the foot, said sections being moldable at temperatures between 200° F. and 350° F. and said sections being permanently molded so that they are substantially free of compression set at temperatures below 200° F.;

said resilient sections being directly adjacent one another to form said grid; and said grid of resilient sections comprising substantially all of said inner sole and extending over substantially all of said sole area;

wherein said resilient sections have a height, a width and a depth, said height being substantially equal to or greater than said width and depth;

each said section being independently removable from said footgear;

said sections being less than ¾ inch in transverse extent;

said elements or sections being moldable to retain the configuration of the patient's foot, with the heights of the sections being deformed to retain different heights in accordance with the pressure applied to the sections of the insole by the patient's foot; and said sections as defined above including means for permitting swaying of each section involving swaying movement of the upper surface of each section, with the lower surface of each section remaining fixed;

whereby the resilience of the sections at normal ambient temperatures below 200° F. is substantially independent of the heat deformable characteristics of said sections.

2. A customizable orthopaedic footgear as defined in claim 1 wherein said sections include at least three materials, a low density resilient top layer for maintaining contact with the foot or sock of the user; a central deformable layer permanently deformed to the shape of a foot, and a high density resilient lower layer.

3. A customizable orthopaedic footgear as defined in claim 1 wherein said deformable layer is permanently heat deformed to the shape of the patient's foot.

4. A customizable orthopaedic footgear as defined in claim 1 wherein said sections are hexagonal in transverse cross sectional configuration.

5. A customizable orthopaedic footgear as defined in claim 1 wherein the upper surfaces of at least some of said sections are deformed to retain angles other than the horizontal.

6. A customizable orthopaedic footgear comprising:

an outer sole;

an inner sole extending substantially over the entire sole area mounted in said footgear above said outer sole, said inner sole having a plurality of independently vertically movable sections arranged in a grid pattern, said independently vertically movable sections having lower surfaces which are mounted within said footgear and said sections together form a substantially smooth surface for engagement by the foot;

said resilient sections being directly adjacent one another to form said grid; and said grid of resilient sections comprising substantially all of said inner sole and extending over substantially all of said sole area;

wherein said resilient sections have a height, a width and a depth, the uncompressed height of said sections being substantially equal to or greater than said width and depth;

each said section including a material which is permanently heat deformable at a an elevated temperature substantially between 200° F. and 350° F., whereby a customized orthopaedic support footgear is provided; and said sections having a configuration following heat deformation wherein the elements are deformed to retain different vertical extents depending on the pressure applied to each section during elevated temperature molding, conforming to the shape of the foot.

7. A customizable orthopaedic footgear as defined in claim 6 wherein said sections include at least three materials, a low density resilient top layer for maintaining contact with the foot or sock of the user, a central deformable layer permanently deformed to the shape of a foot, and a high density resilient lower layer.

8. A customizable orthopaedic footgear as defined in claim 6 wherein said sections are less than ¾ inch in transverse extent.

9. A customizable orthopaedic footgear as defined in claim 6 wherein the upper surfaces of at least some of said sections are deformed to retain angles other than the horizontal.

10. A customizable orthopaedic footgear comprising:

an outer sole;

an inner sole mounted in said footgear above said outer sole, said inner sole having a plurality of independently vertically movable, moldable sections arranged in a grid pattern, said independently vertically movable sections having lower surfaces which are mounted within said footgear, and upper surfaces for engagement by the foot;

said resilient sections being directly adjacent one another to form said grid; and wherein said resilient sections having a height, and a transverse extent, said height being at least equal to or greater than one-half of said transverse extent;

said sections being less than ¾ inch in transverse extent; and said elements or sections being permanently moldable to retain a contour conforming to the configuration of the patient's foot, with the sections being deformed to retain different heights in accordance with the pressure applied to the sections of the insole by the patient's foot.

11. A customizable orthopaedic footgear as defined in claim 10 wherein said sections include at least three materials, a low density resilient top layer for maintaining contact with the foot or sock of the user, a central layer permanently deformed to the shape of a foot, and a high density resilient lower layer.

12. A customizable orthopaedic footgear as defined in claim 10 wherein said sections are hexagonal in transverse cross sectional configuration.

13. A customizable orthopaedic footgear as defined in claim 10 wherein the upper surfaces of at least some of said sections are deformed to retain angles other than the horizontal.

14. A customizable orthopaedic footgear comprising:

an outer sole;

an inner sole extending substantially over the entire sole area mounted in said footgear above said outer sole, said inner sole having a plurality of independently vertically movable, tall sections arranged in a grid pattern, said independently vertically movable tall sections having lower surfaces which are mounted within said footgear, and upper surfaces for engagement by the foot;

said resilient sections being directly adjacent one another to form said grid; and said grid of resilient sections comprising substantially all of said inner sole and extending over substantially all of said sole area;

wherein said resilient sections have a height, a width and a depth, said height being substantially equal to or greater than said width and depth;

each said section being independently removable from said footgear;

said sections being less than ¾ inch in transverse extent;

said sections being permanently deformable to retain the contour of the patient's foot; and said sections as defined above including means for permitting swaying of each section involving swaying movement of the upper surface of each section, with the lower surface of each section remaining fixed.

15. A customizable orthopaedic footgear as defined in claim 14 wherein said sections are heat moldable to permanently conform to the shape of the users foot.

16. A customizable orthopaedic footgear as defined in claim 14 wherein said sections include at least three materials, a low density resilient top layer for maintaining contact with the foot or sock of the user, a central deformable layer permanently deformed to the shape of a foot, and a high density resilient lower layer.

17. A customizable orthopaedic footgear comprising:

an outer sole;

an inner sole mounted in said footgear above said outer sole, said inner sole havening a plurality of independently vertically movable, tall sections arranged in a grid pattern, said independently vertically movable tall sections having lower surfaces which are mounted within said footgear, and upper surfaces for engagement by the foot;

said resilient sections being directly adjacent one another to form said grid; and wherein said resilient sections have a height, and a transverse extent, said height being substantially equal to or greater than said transverse extent;

each said section being independently removable from said footgear;

said sections being less than ¾ inch in transverse extent;

said sections being permanently deformable to retain the configuration of the patient's foot;

said sections as defined above including means for permitting swaying of each section involving swaying movement of the upper surface of each section, with the lower surface of each section remaining fixed; and filler sections having a periphery substantially the same shape as said tall sections, but having a height which is less than half the height of said tall sections, for inserting into spaces when selected tall sections are removed.

18. A customizable orthopaedic footgear comprising:

an outer sole;

an inner sole extending substantially over the entire sole area mounted in said footgear above said outer sole, said inner sole having a plurality of independently vertically movable, tall sections arranged in a grid pattern, said independently vertically movable tall sections having lower surfaces which are mounted within said footgear, and upper surfaces for engagement by the foot;

said resilient sections being directly adjacent one another to form said grid; and said grid of resilient sections comprising substantially all of said inner sole and extending over substantially all of said sole area;

wherein said resilient sections have a height, a width and a depth, said height being substantially equal to or greater than said width and depth;

each said section being independently removable from said footgear, said sections being less than ¾ inch in transverse extent; and said sections being permanently deformable to retain the contour of the patient's foot;

said sections as defined above including means for permitting swaying of each section involving swaying movement of the upper surface of each section, with the lower surface of each section remaining fixed; and filler sections having a periphery substantially the same shape as said tall sections, but having a height which is less than half the height of said tall sections, for inserting into spaces when selected tall sections are removed.

19. A customizable orthopaedic footgear as defined in claim 18 wherein said sections are heat moldable to permanently conform to the shape of the users foot.

20. A customizable orthopaedic footgear as defined in claim 18 wherein said sections are hexagonal in transverse cross sectional configuration.

21. A customizable orthopaedic footgear comprising:

an outer sole:

an inner sole extending substantially over the entire sole area mounted in said footgear above said outer sole, said inner sole having a plurality of independently vertically movable sections arranged in a grid pattern, said independently vertically movable sections having lower surfaces which are mounted within said footgear and said sections together form a substantially smooth surface for engagement by the foot;

said resilient sections being directly adjacent one another to form said grid;

wherein said resilient sections have a height, a width and a depth, said height being substantially equal to or greater than said width and depth; and said sections including a material which is permanently heat deformable at a temperature substantially between 200° F. and 350° F. whereby a customized orthopaedic support footgear is provided.

22. A customizable orthopaedic insole comprising:

a basic member;

said insole extending substantially over the entire sole area of the foot of the user; said insole having a plurality of independently vertically movable sections arranged in a grid pattern, said independently vertically movable sections having lower surfaces which are mounted onto said base member and said sections together form a substantially smooth surface for engagement by the foot;

said resilient sections being directly adjacent one another to form said grid; and wherein said resilient sections have a height, a width and a depth, said height being substantially equal to or greater than said width and depth;

each said section being independently removable from said base member;

each said section including a material which is permanently heat deformable at a temperature substantially between 200° F. and 350° F. whereby a customized orthopaedic support insole is provided.

23. A customizable orthopaedic insole as defined in claim 22 wherein said insole has a heel area and a ball area extending respectively under the heel and under the ball of the foot of a user; and wherein said grid of sections extends over substantially the entire heel area and the entire ball area.

24. A customizable orthopaedic insole as defined in claim 22 wherein said sections as defined above including means for permitting swaying of each section involving swaying movement of the upper surface of each section, with the lower surface of each section remaining fixed to said base member.

* * * * *